US011299371B2

(12) United States Patent
Sun et al.

(10) Patent No.: US 11,299,371 B2
(45) Date of Patent: Apr. 12, 2022

(54) SYSTEM AND METHOD FOR DETECTING ELEVATOR MAINTENANCE BEHAVIOR IN ELEVATOR HOISTWAY

(71) Applicant: Otis Elevator Company, Farmington, CT (US)

(72) Inventors: Yuanjing Sun, Shanghai (CN); Jie Xi, Shanghai (CN); JunYang Lin, Shanghai (CN); TianYuan Chen, Shanghai (CN); Zhen Jia, Shanghai (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 244 days.

(21) Appl. No.: 16/668,725

(22) Filed: Oct. 30, 2019

(65) Prior Publication Data

US 2020/0130999 A1 Apr. 30, 2020

(30) Foreign Application Priority Data

Oct. 30, 2018 (CN) ..... 201811277196.3

(51) Int. Cl.
*B66B 5/00* (2006.01)

(52) U.S. Cl.
CPC ..... *B66B 5/0062* (2013.01)

(58) Field of Classification Search
CPC ..... B66B 5/00; B66B 5/0025; B66B 5/0087; B66B 1/3461; B66B 5/0018;
(Continued)

(56) References Cited

U.S. PATENT DOCUMENTS 8,218,819 B2 7/2012 Cobb et al.
8,438,127 B2 * 5/2013 Kurata ..... H04W 4/021 706/48

(Continued)

FOREIGN PATENT DOCUMENTS

CN 103425971 A 12/2013
CN 204999459 U 1/2016

(Continued)

OTHER PUBLICATIONS

European Search Report for Application No. 19206340.2; dated Jun. 17, 2020; 6 Pages.

(Continued)

*Primary Examiner* — Marlon T Fletcher
(74) *Attorney, Agent, or Firm* — Cantor Colburn LLP

(57) ABSTRACT

A system and method for detecting elevator maintenance behaviors in an elevator hoistway. The system of the invention comprises: an emitting component for emitting wireless signals including channel state information (CSI) into the elevator hoistway; a receiving component for receiving the CSI from the elevator hoistway; and a maintenance behavior detecting device, which comprises: a memory that stores CIS image recognition models constructed corresponding to the predefined elevator maintenance behaviors and a corresponding computer program executable on a processor, and the processor configured to be able to execute the computer program to implement the following operations: processing data of the received CSI to obtain a CSI image corresponding to the elevator maintenance behavior detected, and inputting the CSI image to the CSI image recognition model for analysis and processing so as to detect the elevator maintenance behavior.

23 Claims, 4 Drawing Sheets

(58) Field of Classification Search
CPC ..... B66B 5/0031; B66B 1/3492; B66B 3/00; B66B 3/002; B66B 5/0006; B66B 5/0012; B66B 25/006; B66B 5/005
See application file for complete search history.

(56) References Cited

U.S. PATENT DOCUMENTS

| | | | | |
|---|---|---|---|---|
| 8,514,087 | B2 | 8/2013 | Little et al. | |
| 9,208,675 | B2 | 12/2015 | Xu et al. | |
| 9,218,545 | B2 | 12/2015 | Fahn et al. | |
| 9,359,171 | B1 | 6/2016 | Nowel | |
| 9,672,568 | B1 | 6/2017 | Slusar et al. | |
| 9,714,037 | B2 | 7/2017 | Deruyck et al. | |
| 9,905,107 | B2 | 2/2018 | Chong et al. | |
| 2007/0261924 | A1* | 11/2007 | Lindberg | B66B 1/3423 187/391 |
| 2012/0018256 | A1* | 1/2012 | Mangini | B66B 5/0043 187/247 |
| 2012/0109872 | A1 | 5/2012 | Havinga et al. | |
| 2013/0175121 | A1* | 7/2013 | Hanninen | B66B 1/34 187/380 |
| 2017/0265784 | A1* | 9/2017 | Santello | A61B 5/11 |
| 2017/0296129 | A1 | 10/2017 | Petterson et al. | |
| 2018/0086597 | A1* | 3/2018 | Song | G05B 15/02 |
| 2018/0153430 | A1 | 6/2018 | Ang et al. | |
| 2019/0382237 | A1* | 12/2019 | Witczak | B66B 3/002 |
| 2019/0382239 | A1* | 12/2019 | Witczak | B66B 5/0025 |
| 2020/0130999 | A1* | 4/2020 | Sun | B66B 5/0087 |
| 2020/0207578 | A1* | 7/2020 | Liaskas | B66B 5/0025 |

FOREIGN PATENT DOCUMENTS

| | | | |
|---|---|---|---|
| CN | 106941602 | A | 7/2017 |
| EP | 3392181 | A1 | 10/2018 |
| WO | 2017162552 | A2 | 9/2017 |

OTHER PUBLICATIONS

Shu, G., et al., "Violent Behavior Detection Based on SVM in the Elevator", abstract, International Journal of Security and its Applications 8(5):31-40, Sep. 2014, 3 pages.

* cited by examiner

SYSTEM AND METHOD FOR DETECTING ELEVATOR MAINTENANCE BEHAVIOR IN ELEVATOR HOISTWAY

FOREIGN PRIORITY

This application claims priority to Chinese patent application No. 201811277196.3, filed on Oct. 30, 2018, and all the benefits accruing therefrom under 35 U.S.C. § 119, the contents of which in its entirety are herein incorporated by reference.

FIELD OF THE INVENTION

The present disclosure pertains to the technical field of elevator maintenance, and it relates to detection of elevator maintenance behaviors in an elevator hoistway based on Channel State Information (CSI).

BACKGROUND OF THE INVENTION

Many key equipment of an elevator system (e.g. elevator cab, equipment of a machine room, etc.) are installed in the elevator hoistway (or "elevating passage"). According to the maintenance norms or regulations of elevator systems, maintenance staffs (or named as "maintainers") are required to regularly carry out on-site maintenance of the equipments in the elevator hoistway.

However, due to the particularity of the elevator hoistway environment (such as poor light and blocked environment), it is difficult for people outside the elevator hoistway to monitor the elevator maintenance behaviors of the maintainer in the elevator hoistway, and the maintainer in the elevator hoistway is also liable to not carry out elevator maintenance operations in accordance with the maintenance operation norms, such as carry out highly dangerous maintenance operations at will.

SUMMARY OF THE INVENTION

According to a first aspect of the present disclosure, a system for detecting elevator maintenance behaviors in an elevator hoistway is provided, which comprises: an emitting component for emitting wireless signals including the Channel State Information (CSI) into the elevator hoistway; a receiving component for receiving the CSI from the elevator hoistway; and a maintenance behavior detecting device coupled to the receiving component, which comprises: a memory that stores CIS image recognition models constructed corresponding to one or more predefined elevator maintenance behaviors and a corresponding computer program executable on a processor; and the processor, which is configured to be able to execute the computer program to implement the following operations: processing data of the received CSI to obtain a CSI image corresponding to the elevator maintenance behavior detected; and inputting the CSI image to the CSI image recognition model for analysis and processing so as to detect the elevator maintenance behavior.

In the system according to one embodiment of the present disclosure, the operation of processing data of the received CSI to obtain a series of CSI images corresponding to the elevator maintenance behaviors detected includes the following procedures: denoising the received CSI; removing background information from the CSI; and converting the CS, removed the background information therefrom, corresponding to multiple subcarriers to generate a corresponding CSI image.

In the system according to another embodiment or any of the above embodiments of the present disclosure, the emitting component and the receiving component are mounted on the outer top of the elevator cab in the elevator hoistway, and the emitting component and the receiving component travel synchronously with the elevator cab.

In the system according to another embodiment or any of the above embodiments of the present disclosure, the emitting component is a WiFi wireless access point device, and the receiving component is a WiFi wireless network card.

In the system according to another embodiment or any of the above embodiments of the present disclosure, the predefined elevator maintenance behaviors include a dangerous maintenance behavior; and the elevator maintenance behaviors are identified as the dangerous maintenance behavior or not in the operation of inputting the CSI image to the CSI image recognition model for analysis and processing so as to detect the elevator maintenance behavior.

In the system for according to another embodiment or any of the above embodiments of the present disclosure, the predefined elevator maintenance behaviors includes multiple types of maintenance behaviors; the operation of inputting the CSI image to the CSI image recognition model for analysis and processing so as to detect the elevator maintenance behavior includes: classifying the elevator maintenance behavior into a certain type of maintenance behavior.

The system according to another embodiment or any of the above embodiments of the present disclosure further comprises: a reminder component which is used to send a reminder signal indicating that the elevator maintenance behavior currently being detected is the dangerous maintenance behavior.

In the system according to another embodiment or any of the above embodiments of the present disclosure, the CSI image recognition model includes a behavior feature library corresponding to behavior feature models of the predefined elevator maintenance behaviors.

In the system according to another embodiment or any of the above embodiments of the present disclosure, the processor is further configured to be able to execute the computer program to implement the following operations: collecting the CSI corresponding to the predefined elevator maintenance behaviors and using it as training data; and training on the basis of the training data to obtain the behavior feature models.

In the system according to another embodiment or any of the above embodiments of the present disclosure, the processor is further configured to be able to execute the computer program to implement the following operations: inputting the recognized CSI image as training data into an original CSI image recognition model that has stored the behavior feature model; and updating the original CSI image recognition model using a machine learning algorithm to obtain the CSI image recognition model.

In the system according to another embodiment or any of the above embodiments of the present disclosure, the processor is further configured to be able to execute the computer program to implement the following operations: corresponding the time, amplitudes of multiple subcarriers in the time domain and frequencies of multiple subcarriers in the time domain of the CSI to R, G and B components of an image and realizing a matrix representation to generate the CSI image; segmenting an image flow using a time window to obtain a series of CSI images; inputting the series of CSI images into the CSI image recognition model for analysis and processing to identify the elevator maintenance behavior.

In the system according to another embodiment or any of the above embodiments of the present disclosure, the CSI image recognition model is a convolution neural network model.

According to a second aspect of the present disclosure, a method for detecting elevator maintenance behaviors in an elevator hoistway is provided, which comprises the steps of: (S1) receiving channel state information CSI, wherein the CSI is included in wireless signals emitted into the elevator hoistway; (S2) processing data of the received CSI to obtain a CSI image corresponding to the elevator maintenance behavior detected; and (S3) inputting the CSI image to a CSI image recognition model for analysis and processing so as to detect the elevator maintenance behavior, wherein the CSI image recognition model is constructed corresponding to one or more predefined elevator maintenance behaviors.

The method according to one embodiment of the present disclosure, wherein the step (S2) includes: a data preprocessing sub-step, which includes denoising the received CSI; a background removing sub-step to remove background information from the CSI; an image converting sub-step to converting the CSI, removed the background information therefrom, corresponding to multiple subcarriers to generate a corresponding CSI images.

The method according to another embodiment or any of the above embodiments of the present disclosure, wherein the predefined elevator maintenance behaviors include a dangerous maintenance behavior; the step (S3) includes identifying whether the elevator maintenance behavior is dangerous maintenance behaviors.

The method according to another embodiment or any of the above embodiments of the present disclosure, wherein the predefined elevator maintenance behaviors include various types of maintenance behaviors; the step (S3) includes classifying the elevator maintenance behaviors into a certain type of maintenance behavior.

The method according to another embodiment or any of the above embodiments of the present disclosure further comprises the step of sending a reminder signals upon identifying the dangerous maintenance behavior.

The method according to another embodiment or any of the above embodiments of the present disclosure, wherein the CSI image recognition model includes a behavior feature library corresponding to behavior feature models of the predefined elevator maintenance behaviors; the method further comprises the following steps; collecting the CSI corresponding to the predefined elevator maintenance behaviors and using it as training data; and training on the basis of the training data to obtain the behavior feature models.

The method according to another embodiment or any of the above embodiments of the present disclosure, wherein the CSI image recognition model is constructed or updated through the following operations: inputting the recognized CSI image as training data into an original CSI image recognition model that has stored the behavior feature model; and updating the original CSI image recognition model using a machine learning algorithm to obtain the CSI image recognition model.

The method according to another embodiment or any of the above embodiments of the present disclosure, wherein the step (S2) includes: corresponding the time, amplitudes of multiple subcarriers in the time domain and frequencies of multiple subcarriers in the time domain of the CSI to R, G and B components of the image and realizing a matrix representation to generate the CSI image; segmenting an image flow using a time window to obtain a series of CSI images; the step (S3) includes: inputting the series of CSI images into the CSI image recognition model for analysis and processing to identify the elevator maintenance behavior.

The method according to another embodiment or any of the above embodiments of the present disclosure, wherein the CSI image recognition model is a convolution neural network model.

According to a third aspect of the present disclosure, a computer device is provided, which comprises a memory, a processor, the CSI image recognition model stored on the memory and constructed corresponding to one or more predefined elevator maintenance behaviors, and corresponding computer programs executable on the processor, wherein the processor can execute the programs to implement the steps of any of the methods described above.

According to a fourth aspect of the present disclosure, a computer-readable storage medium is provided, on which a CSI image recognition model constructed corresponding to one or more predefined elevator maintenance behaviors and the corresponding computer programs executable on the processor are stored, wherein said programs can be executed by the processor to implement steps of any one of the above described methods.

The above features and operations of the present disclosure will become more obvious from the following descriptions and drawings.

BRIEF DESCRIPTION OF THE DRAWINGS

The above and other objects and advantages of the present disclosure will become clearer and more complete from the following detailed descriptions given in conjunction with the drawings, wherein the same or similar elements are denoted by the same reference sign.

DETAILED DESCRIPTION OF THE EMBODIMENTS OF THE INVENTION

In the text below, for the convenience of description, the system for detecting elevator maintenance behaviors in an elevator hoistway is referred to as the "detecting system", and the method for detecting elevator maintenance behaviors in an elevator hoistway is referred to as the "detecting method".

The present disclosure will now be described with reference to the accompanying drawings which show specific exemplary embodiments. Said embodiments can be changed electronically, logically and structurally without departing from the spirit and scope of the present invention. Furthermore, although the features of the present invention are disclosed in conjunction with only one of several implementations/embodiments, said features may be combined with one or more other features of other implementations/embodiments as long as it is expected and/or beneficial for any given or recognizable function.

The terms "first", "second", etc. used herein do not necessarily mean any order or priority relationship, but they can be used to more clearly distinguish objects from each other.

Figure 1:
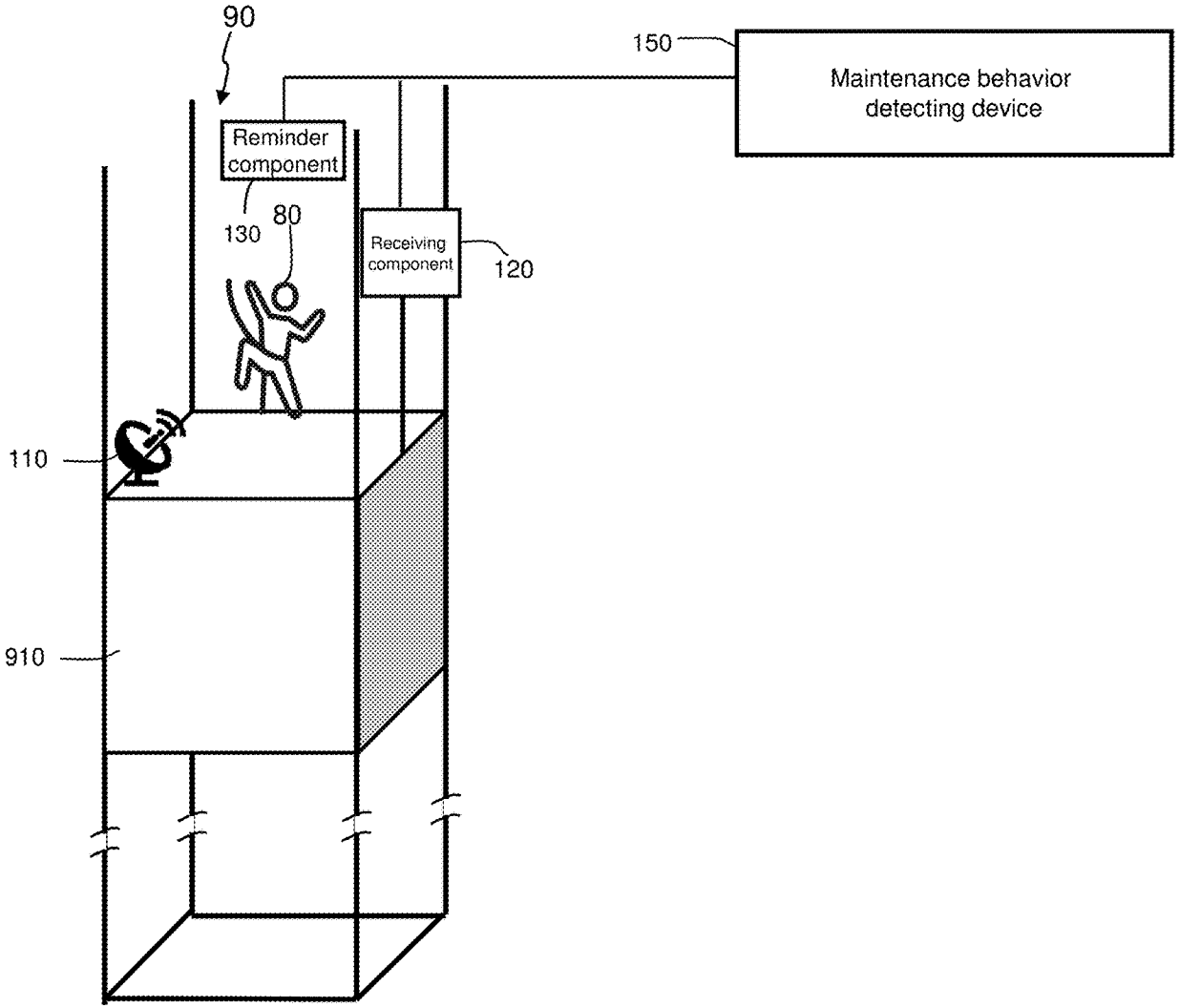
FIG. 1 is a schematic diagram of a system for detecting elevator maintenance behaviors in an elevator hoistway according to an embodiment of the present disclosure.
Figure 2:
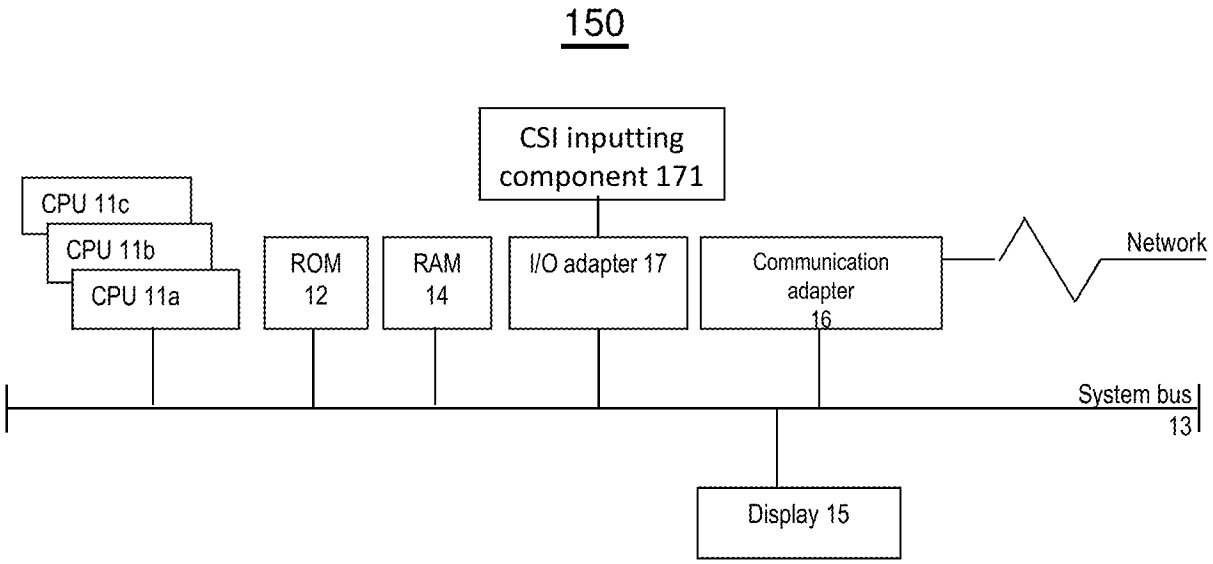
FIG. 2 is a schematic diagram of the basic structure of a maintenance behavior detecting device according to an embodiment of the present disclosure.
Figure 3:
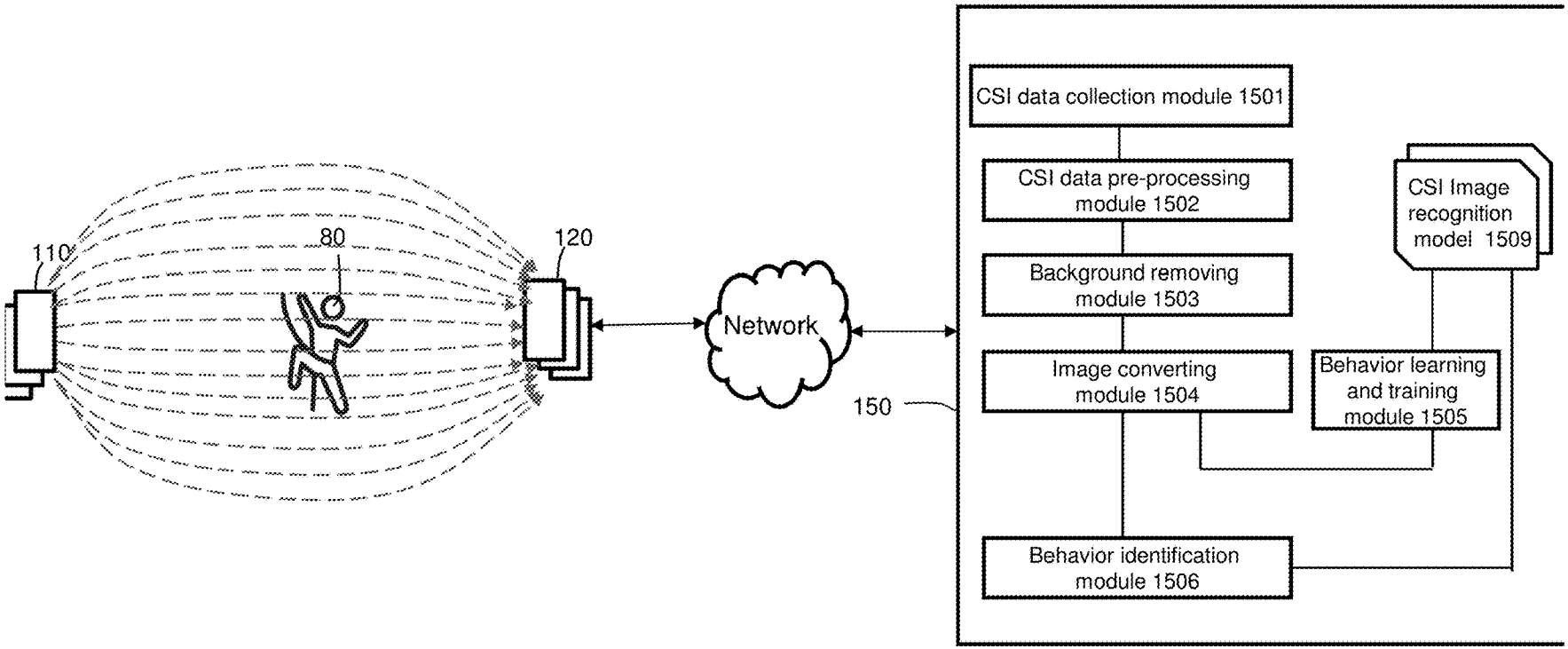
FIG. 3 is a schematic diagram of the basic working principle of the system for detecting elevator maintenance behaviors in an elevator hoistway according to an embodiment of the present disclosure.

FIG. 1 is a schematic diagram of a detecting system according to an embodiment of the present disclosure; FIG. 2 is a schematic diagram of the basic structure of a maintenance behavior detecting device according to an embodiment of the present disclosure; FIG. 3 is a schematic diagram of the basic working principle of the detecting system according to an embodiment of the present disclosure.

As shown in FIG. 1, a detecting system 100 according to one embodiment of the present disclosure may be arranged corresponding to one or more elevator hoistways 90 in a building, or corresponding to elevator hoistways 90 of one or more buildings. Equipments of the elevator system in the elevator hoistway 90 are not limited to the elevator cab 910 as shown in FIG. 1, and it shall be understood that there are also many other components, such as components that are needed for the maintainer 80 to perform the elevator maintenance operations in the elevator hoistway.

The detecting system 100 is used to detect the elevator maintenance behaviors of the maintainer 80, so as to achieve the effect of monitoring the elevator maintenance behaviors of the maintainer 80. The maintainer 80 can be a maintenance operator, for example, a person trained for elevator maintenance operations; however, it should be understood that the maintainer 80 is not limited to a person, for example, it can be a device that can automatically perform elevator maintenance operations. Elevator maintenance behaviors are behaviors of the maintainer in the elevator hoistway during elevator maintenance, which may include behaviors that conform to the maintenance operation rules, and behaviors that do not conform to the maintenance operation rules, such as dangerous behaviors made by the maintainer accidentally.

As shown in FIG. 1 and FIG. 3, in one embodiment, the detecting system 100 comprises one or more emitting components 110 arranged in the elevator hoistway, which are capable of emitting wireless signals including the CSI into the elevator hoistway 90; it shall be understood that by adjusting the installation position of the emitting component 110 in the elevator hoistway 90, the area covered by the wireless signals can be adjusted, which includes the area where the elevator maintenance behaviors to be detected occurs. The detecting system 100 comprises one or more receiving components 120 arranged in the elevator hoistway, which can be installed corresponding to the emitting components 110 so as to receive the CSI data included in the wireless signals from the elevator hoistway.

Specifically, the emitting component 110 may be, but is not limited to, a WiFi wireless access point (AP) device (e.g., a WiFi router) capable of emitting, for example, WiFi wireless signals with the frequency band of 2.4G or 5G, and correspondingly, the receiving component 120 may be, but is not limited to, a WiFi wireless network card.

In one embodiment, as shown in FIG. 1, in order to detect elevator maintenance behaviors occurred on the top of the elevator cab 910, the emitting component 110 and receiving component 120 are installed on the outer top of the elevator cab 910, and the emitting component 110 and receiving component 120 can travel synchronously with the elevator cab 910, thus even if the position of the elevator cab 910 in the elevator hoistway 90 changes, the relative positions of the emitting component 110 and the receiving component 120 remain unchanged, and the signal field between them is basically unaffected by the position change of the elevator cab 910, which is advantageous for accurate detection and identification of the elevator maintenance behaviors. Specifically, the emitting component 110 and the receiving component 120 can be fixed on some fixed parts on the outer top of the elevator cab 910; the emitting component 110 and the receiving component 120 can be electrically connected to the power supply of the elevator cab 910, for example, so that they can be easily powered by the power supply of the elevator system.

It will be understood that the emitting component 110 and receiving component 120 are not confined to be installed on the outer top of the elevator cab 910, but they can also be installed in other areas in the elevator hoistway 90 where the elevator maintenance behaviors occur.

In one embodiment, as shown in FIG. 1 and FIG. 3, the detecting system 100 further comprises a maintenance behavior detecting device 150, which can be connected to the receiving component 120 via a network to receive the CSI transmitted by the receiving component 120. The network can be an elevator system communication network, an Internet and the like or a combination thereof.

The maintenance behavior detecting device 150 can be implemented by, for example, a computer device, and it can be deployed as a server in a building, or in a cloud, for example.

Referring to FIG. 2, which shows an embodiment of the computer device for implementing the maintenance behavior detecting device 150 of the present disclosure. In this embodiment, the maintenance behavior detecting device 150 has one or more central processing units (processors) 11*a*, 11*b*, 11*c*, etc. (collectively or generally referred to as processors 11). It will be understood that the computing power of the computer device 10 is mainly determined by the processor 11. In one or more embodiments, each processor 11 may include a Reduced Instruction Set Computer (RISC) microprocessor; the processor 11 is coupled to a system memory 14 (RAM) and various other components through a system bus 13; a read-only memory (ROM) 12 is coupled to the system bus 13 and may include a Basic Input/Output System (BIOS) that controls some basic functions of the computer device 10.

The RAM 14 may store corresponding program instructions of the present disclosure. The processor 11 may execute program instructions on RAM 14 during detection process for elevator maintenance behavior, so that the functions of the system for detecting elevator maintenance behaviors in the embodiment of the present disclosure can be realized.

It will be understood that the RAM 14 can also store the CSI image recognition model constructed on the basis of the CSI as desired, and of course, it can also store other information used for learning and training the CSI image recognition model, such as training data, etc., which can be implemented in the form of a database.

Still referring to FIG. 2, which also shows an input/output (I/O) adapter 17 and a network adapter 16 coupled to the system bus 13. The I/O adapter 17 may be connected to a CSI input component 171 so that the system bus 13 can receive CSI data from the receiving component 120. The network communication adapter 16 interconnects the bus 13 with an external network 700, enabling the data processing computer device 10 to communicate wirelessly with a remote (e.g. cloud) recognition engine. A screen (e.g., a display monitor) 35 is connected to the system bus 33 through the display adapter 32.

Still referring to FIG. 2, which also shows a display 15 which, for example, can display a state (e.g. network connection state) of the computer device 10, a result of identification of the elevator maintenance behaviors, etc. In other embodiments, the display 15 can be omitted.

It will be understood that the computer device 10 may also include other components not shown in FIG. 2 above, such as a speaker for voice output. The computer device 10 described here is merely exemplary and is not intended to restrict the application, use and/or technology.

As shown in FIG. 3, the emitting component 110 broadcasts or emits wireless signals to local areas of the elevator hoistway 90, and the receiving component 120 can be wirelessly connected to the transmitting component 110, of course, it can also receive the CSI of the wireless signals, especially changes of the CSI.

The CSI can represent channel attributes of communication links, and it describes and reflects the status of propagation of wireless signals from the emitting component 110 to the receiving component 120, especially the attenuation factors on each transmission path, such as signal scattering, environmental attenuation, distance attenuation, reflection, etc.; besides, the CSI of subcarriers can reflect the signal intensities at different frequencies, and the CSI of each subcarrier can also be acquired by the receiving component 120. Different actions or behaviors of the maintainer 80 on the wireless signal propagation path will affect the propagation of the wireless signals, thereby changing or affecting the channel attributes of the corresponding communication links, which are embodied in the changes of CSI, such as the changes of the amplitude or intensity of the CSI of multiple subcarriers in the time domain. When the elevator maintenance behaviors of the maintainer 80 are different, it can also be reflected in the changes of the CSI of multiple subcarriers. Therefore, the detecting system 100 of one embodiment of the present disclosure identifies the maintenance behaviors of the maintainer 80 in the elevator hoistway based on identifying the change pattern of the CSI.

Referring to FIG. 3, the basic working principle of the maintenance behavior detecting device 150 will be described as an example.

In one embodiment, the maintenance behavior detecting device 150 is configured or installed with a CSI image recognition model 1509, which can be stored in the memory 14 of the maintenance behavior detecting device 150, for example. The CSI image recognition model 1509 can be specifically but not limited to a CNN (Convolution Neural Network) model, and when using the CNN model, the rate of identification of the elevator maintenance behaviors can be raised. The CSI image recognition model 1509 can be constructed by the maintenance behavior detecting device 150, such as by learning and training the original model using the CSI data or CSI image data corresponding to a certain kind of elevator maintenance behavior collected by the maintenance behavior detecting device 150. The CSI image recognition model 1509 can be constructed by the maintenance behavior detecting device 150, and of course it can also be obtained from the outside, for example, it can be obtained from the network and installed in the maintenance behavior detecting device 150.

The CSI image recognition model 1509 can be constructed to correspond to one or more predefined elevator maintenance behaviors, for example, one or more predefined elevator maintenance behaviors correspond to one or more behavior feature models of the CSI image recognition model 1509. Wherein, the predefined elevator maintenance behaviors are known elevator maintenance behaviors, the size or length of the predefined elevator maintenance behavior can be segmented according to the elevator maintenance operation and the analysis and identification ability of neural network model; the predefined elevator maintenance behaviors may include, for example, jumping, falling, climbing, bending and other actions. The standard maintenance behavior for a certain kind of predefined elevator maintenance behavior can be defined in advance according to, for example, the elevator maintenance operation rules, or according to the known elevator maintenance operations which obviously do not conform to the elevator maintenance operation rules.

Still referring to FIG. 3, a CSI data collection module 1501 is arranged in the maintenance behavior detecting device 150, which can receive the CSI, for example, collect the CSI data corresponding to the current elevator maintenance behavior. It shall be understood that the collected CSI data can also include the corresponding time information.

Still referring to FIG. 3, a CSI data pre-processing module 1502 can also be arranged in the maintenance behavior detecting device 150. The CSI data pre-processing module 1502 can denoise the CSI obtained by the CSI data collection module 1501, such as removing common mode noises of multiple subcarriers, so that less useful CSI is lost. Of course, the CSI data pre-processing module 1502 can also perform other data pre-processing to improve the accuracy of identification of the elevator maintenance behaviors.

Still referring to FIG. 3, a background removal module 1503 can also be arranged in the maintenance behavior detecting device 150, which is used to remove background information from the CSI; it will be understood that the background information can be collected and stored, for example, in the memory 14 of the maintenance behavior detecting device 150 in advance after installation of the emitting component 110 and the receiving component 120. The background information can be obtained by receiving the CSI in a circumstance where, for example, no maintainer 80 exists. It shall be understood that in different application scenarios, the definition of background may change accordingly.

Still referring to FIG. 3, an image converting module 1504 can also be arranged in the maintenance behavior detecting device 150 to convert the CSI having the background removed therefrom and corresponding to multiple subcarriers to generate the corresponding CSI image, wherein the multiple subcarriers may include multiple subcarriers of multiple antenna channels of the receiving component 120. Thus the obtained CSI image can be easily input into the CSI image recognition model 1509 for image recognition and other processing. The existence, absence and various different actions and behaviors of the maintainer 80 can be reflected in the CSI image.

The way of generating the CSI image can specifically be but not limited to: corresponding the time, amplitudes of multiple subcarriers in the time domain and frequencies of multiple subcarriers in the time domain of the CSI to R, G and B components of an image and realizing a matrix representation to generate the CSI image; the thus generated CSI image may include amplitude information, time domain information and the like, and compared with identifying on the basis of inputting a single CSI feature value into the image recognition model, the accuracy of identification of the elevator maintenance behaviors is higher.

It shall be understood that in this application, the CSI image refers to the image generated by CSI conversion, the CSI image recognition model is an image recognition model obtained by machine learning and training on the basis of the CSI or known CSI image.

The CSI image obtained by the image conversion module 1504 may correspond to a certain elevator maintenance behavior according to the time information, thus obtaining a series of CSI images corresponding to a certain elevator maintenance behavior. The number of the series CSI images can be determined by the size of a time window set, for example, the image flow is segmented using the time window to obtain a series of CSI images corresponding to a certain elevator maintenance behavior. It will be understood that for different elevator maintenance behaviors, time windows of different sizes can be set for segmenting. The image conversion module 1504 can extract the series of CSI images that need to be input into the CSI image recognition model 1509 for recognition.

A behavior identification module 1506 can also be arranged in the maintenance behavior detecting device 150. The behavior identification module 1506 can input the series of CSI images obtained, for example, by segmenting using the time window, into the CSI image recognition model 1509 to be analyzed and processed, then the behavior identification module 1506 can obtain image recognition results of the elevator maintenance behaviors, such as determining the types of the elevator maintenance behaviors, whether the elevator maintenance behaviors are dangerous, whether the behaviors are elevator maintenance behaviors, etc.

It will be understood that the capability of the maintenance behavior detecting device 150 for identifying the elevator maintenance behaviors is related to the capability of the CSI image recognition model 1509. In one embodiment, the relatively easily identifiable dangerous maintenance behavior is identified, wherein the CSI image recognition model 1509 can be constructed by learning and training on the basis of various dangerous maintenance behaviors, including, but not limited to, body extending outside the area corresponding to the elevator cab 910, falling, etc., which can be predefined. The CSI image recognition model 1509 stores the corresponding behavior feature models. By identifying the dangerous maintenance behaviors, dangerous behaviors of the maintainer 80 can be monitored during the maintenance operation, which is helpful in stopping the dangerous behaviors in time and preventing the occurrence of dangerous accidents.

In still another embodiment, various types of elevator maintenance behaviors are identified, and the CSI image recognition model 1509 can be constructed by learning and training on the basis of various types of predefined elevator maintenance behaviors. By identifying the elevator maintenance behaviors, we can monitor whether the maintainer 80 generally operates according to the predefined elevator maintenance behavior or even whether the sequence of the elevator maintenance behaviors of the maintainer 80 conforms to the operation rules, thus we can roughly monitor the normativity of the elevator maintenance behaviors of the maintainer 80.

It shall be noted that during analyzing and processing by the CSI image recognition model 1509, the analyzing and processing method is not restrictive, and it varies according to different CSI image recognition models 1509 and/or their construction principles. For example, when the CSI image recognition model 1509 is the CNN model, it consists of five layers, which are an embedded layer, a convolution layer, a pooling layer, a full connection layer and an output layer. Wherein the embedded layer is responsible for the matrix representations of the series of CSI images, which can be input to the convolution layer for operation; the convolution layer extracts feature vectors of the vector matrix through the convolution operation; the pooling layer selects relatively important feature values from the feature vectors extracted from the convolution layer, such as selecting the main features; the full connection layer is a hidden layer to prepare for classification; the output layer can be provided with corresponding classifiers, which can classify and output the category of the currently detected elevator maintenance behavior, e.g. whether it belongs to some kind of dangerous maintenance behavior.

Still referring to FIG. 3, in one embodiment, the maintenance behavior detecting device 150 has the function of constructing or updating the CSI image recognition model 1509 and the behavior feature model therein. Correspondingly, a behavior learning and training module 1505 can be arranged. In one embodiment, the CSI image recognition model 1509 includes a behavior feature library corresponding to behavior feature models of one or more predefined elevator maintenance behaviors, the behavior feature library can collect, from, for example, an elevator maintenance training base, a large amount of CSI data of the predefined elevator maintenance behaviors as training data to construct corresponding behavior feature models, and the CSI data include CSI data generated by maintainers of different shapes making the predefined elevator maintenance behaviors, thereby improving the accuracy of behavior identification. The behavior learning and training module 1505 can collect training data corresponding to predefined elevator maintenance behaviors, and obtain behavior feature models by training on the basis of the training data. This behavior feature model can be embedded in the original CSI image recognition model.

The behavior learning and training module 1505 can further learn and train on the original CSI image recognition model to obtain the CSI image recognition model 1509 corresponding to a certain predefined elevator maintenance behavior. Taking climbing as an example, with respect to the CSI image which has been identified as the climbing maintenance behavior, it is collected as training data, including the CSI images of maintainers 80 with different shapes making the climbing maintenance behavior. It will be understood that the better the training data are, the more advantageous it is to construct or update the CSI image recognition model 1509 with higher recognition accuracy. Similar to the above behavior detection process, the CSI image data used for training can be obtained through the following process: the CSI data pre-processing module 1502 and background removal module 1503 perform noise reduction and background removal processing, respectively, and the image converting module 1504 can also process the CSI data used for training to obtain a series of CSI images corresponding to, for example, the climbing maintenance behavior. The behavior learning and training module 1505 can input the series of CSI images into the original image recognition model or the existing CSI image recognition model for learning and training, thereby constructing or updating the CSI image recognition model 1509 in the maintenance behavior detecting device 100.

During construction of the CSI image recognition model 1509, taking the CSI image recognition model 1509 being the CNN model as an example, the series of CSI images can be input into the convolution neural network for deep learning so as to construct the CNN model, which mainly includes the following process: (a) performing the convolution operation to extract the training-use feature vectors for training the vector matrix; (b) pooling the extracted training-use feature vectors corresponding to the predefined elevator maintenance behaviors to select the relatively important training-use feature values; (c) determining the current category of the predefined elevator maintenance behaviors (such as the climbing maintenance behavior) based on the selected training-use feature vectors; (d) based on the known and current categories of the predefined elevator maintenance behaviors, adjusting parameters of the convolution layer, the pooling layer and/or the classifier of the output layer of the CNN model, such as parameters like the number of network layers, the number of subcarriers, the convolution core and so on.

It shall be noted that with respect to other types of CSI image recognition models 1509, such as other neural network models, according to the required image types, the image converting module 1504 can generate a series of CSI images of the corresponding types for training, and can use known or future learning and training methods to construct the corresponding types of neural network models.

Still referring to FIG. 1, the detecting system 100 may be further provided with a reminder component 130, which is used to send a reminder signal (such as a warning signal), which can remind that the elevator maintenance behavior currently being detected is a dangerous maintenance behavior, thus preventing the maintainer 80 from making further dangerous operation in time. The reminder component 130 may, but not limited to, be installed in the elevator hoistway 90. The reminder component 130 can be controlled by the identification result output by the maintenance behavior detecting device 150, for example, when the maintenance behavior detecting device 150 outputs the identification result of the dangerous maintenance behavior, the reminder component 130 is triggered to work.

Figure 4:
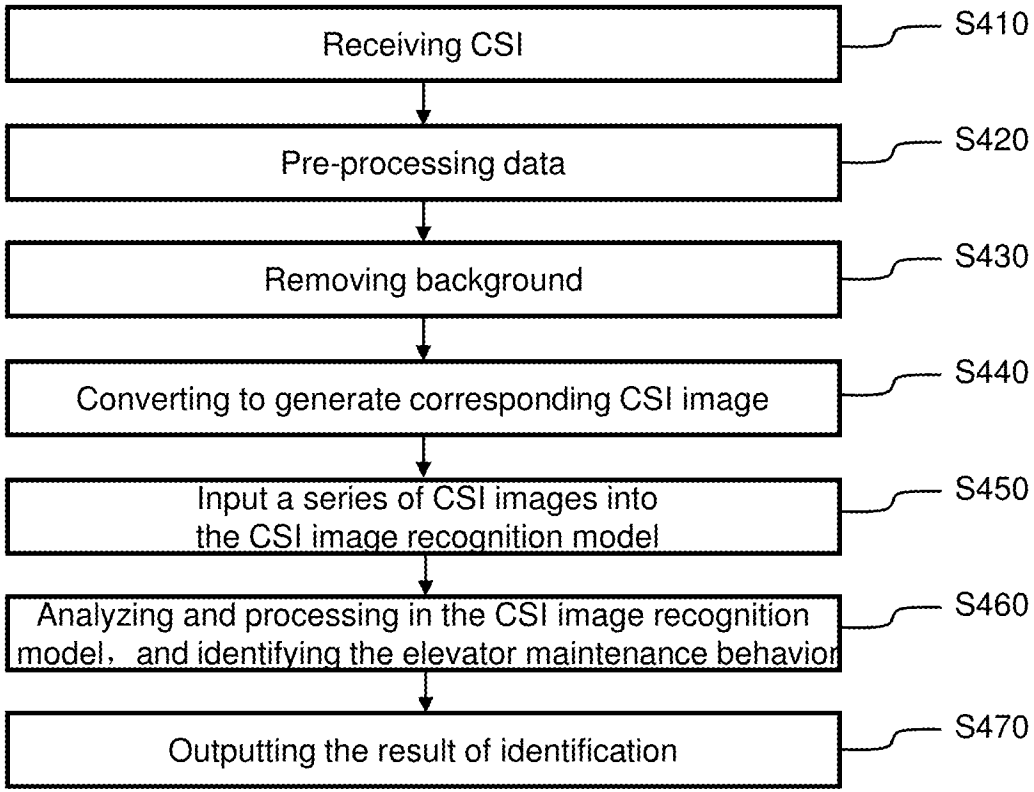
FIG. 4 is a flow chart of a method for detecting elevator maintenance behaviors in an elevator hoistway according to an embodiment of the present disclosure.

FIG. 4 is a flow chart of the method for detecting elevator maintenance behaviors in an elevator hoistway according to an embodiment of the present disclosure. The detecting method in this embodiment can be applied to the detecting system 100 illustrated in FIG. 1 for detecting the elevator maintenance behaviors, especially the elevator maintenance behaviors in the elevator hoistway 90. The detecting method of the embodiment of the present disclosure will be described below with reference to FIG. 1, FIG. 3 and FIG. 4.

First, in step S410, the CSI is received, wherein the CSI is included in the wireless signals emitted into the elevator hoistway 90. In this step, CSI data corresponding to the current elevator maintenance behavior can be collected by the receiving component 120 or the CSI data collection module 1501 of the maintenance behavior detecting device 150. It shall be understood that the collected CSI data may also include the corresponding time information.

In step S420, the received CSI is denoised; for example, the common mode noises of multiple subcarriers are removed, so that less useful CSI is lost. The received CSI includes the CSI of multiple subcarriers.

In step S430, the background information is removed from the CSI, wherein the background information can be obtained in advance after installation of the emitting component 110 and the receiving component 120, and stored, for example, in the memory 14 of the maintenance behavior detecting device 150.

In step S440, the CSI, removed the background therefrom, corresponding to multiple subcarriers is converted to generate the corresponding CSI image, wherein the multiple subcarriers may include multiple subcarriers of multiple antenna channels of the receiving component 120. Thus the obtained CSI image can be easily input into the CSI image recognition model 1509 for image recognition and other processing. The way of generating the CSI image can specifically be but not limited to: corresponding the time, amplitudes of multiple subcarriers in the time domain and frequencies of multiple subcarriers in the time domain of the CSI to R, G and B components of the image and realizing a matrix representation to generate the CSI image; the thus generated CSI image may include amplitude information, time domain information and the like, and compared with identifying on the basis of inputting a single CSI feature value into the image recognition model, the accuracy of identification of the elevator maintenance behaviors is higher.

In step S450, the CSI image, as an input variable, is input into the CSI image recognition model 1509. In this step, if the CSI image recognition model 1509 is the CNN model, the image flow is segmented using the time window to obtain a series of CSI images; for identification of different behaviors, different time windows may be used for segmenting; further, the series of CSI images can be input into the CSI image recognition model 1509.

In step S460, analyzing and processing are performed in the CSI image recognition model to identify the elevator maintenance behaviors. In this step, the corresponding behavior types can be matched by comparing with the behavior feature models, so that the detected behaviors can be classified and the image recognition results of the elevator maintenance behaviors can be obtained, such as determining the types of the elevator maintenance behaviors, whether the elevator maintenance behaviors are dangerous, whether the behaviors are elevator maintenance behaviors, etc.

During analyzing and processing, the analyzing and processing method is not restrictive, and it varies according to different CSI image recognition models 1509 and/or their construction principles. For example, when the CSI image recognition model 1509 is the CNN model, it consists of five layers, which are the embedded layer, the convolution layer, the pooling layer, the full connection layer and the output layer. Wherein the embedded layer is responsible for the matrix representations of the series of CSI images, which can be input to the convolution layer for operation; the convolution layer extracts behavior feature vectors of the vector matrix through the convolution operation; the pooling layer selects relatively important feature values from the feature vectors extracted from the convolution layer, such as selecting the main features; the full connection layer is a hidden layer to prepare for classification; the output layer can be provided with corresponding classifiers, which can classify and output the category of the currently detected elevator maintenance behavior, e.g. whether it belongs to some kind of dangerous maintenance behavior.

In step S470, the result of identification is output. This step may also including determining, according to the result of identification, whether to send a warning signal indicating that the currently detected elevator maintenance behavior is a dangerous maintenance behavior, such as triggering the reminder component 130 to work when the result of identification of the dangerous maintenance behavior is output. As required, the result of identification can be sent to other components or systems, for example, to an elevator maintenance management terminal remotely, to be displayed.

It will be understood that in the above detecting method, the use of the CSI image recognition model 1509 can improve the accuracy of identification of the elevator maintenance behaviors and can relatively easily identify dangerous maintenance behaviors. Furthermore, it can monitor whether the maintainer 80 operates roughly according to the predefined elevator maintenance behaviors, and even monitor whether the sequence of the series of elevator maintenance behaviors of the maintainer 80 conforms to the operation rules. Therefore, it can roughly monitor the normativity of the elevator maintenance behaviors of the maintainer 80.

It should be understood that the above exemplary detecting system 100 and detecting method are less affected by the environment of the elevator hoistway 90, and are very suitable for detecting elevator maintenance behaviors in the elevator hoistway environment.

It shall be noted that some of the block diagrams shown in the drawings are functional entities and do not necessarily correspond to physically or logically independent entities. These functional entities may be implemented in software form, or in one or more hardware modules or integrated circuits, or in different networks and/or processor devices and/or microcontroller devices.

The application is described with reference to the block diagram and/or flow chart of the detecting method and maintenance behavior detecting device according to embodiments of the present disclosure. It shall be understood that illustrations in the flow chart and/or each block of the block diagram, as well as the combination of the illustrations of the flow chart and/or the block diagram can be implemented by computer program instructions. These computer program instructions may be provided to processors of general purpose computers, special purpose computers or other programmable data processing devices to form machines, so that said instructions, executed by the processors of the computers or other programmable data processing devices, can create components for implementing functions/operations specified in the flow charts and/or blocks and/or one or more flow block diagrams.

Said computer program instructions may be stored in the computer-readable memory shown in FIG. 2, and said instructions may instruct the computer or other programmable processors to realize functions in a specific manner, so that said instructions stored in the computer-readable memory can form products that include instruction components for implementing the functions/operations specified in the flow charts and/or one or more blocks of the block diagrams.

Said computer program instructions can be loaded onto computers or other programmable data processors so that a series of operation steps can be executed on the computers or other programmable processors to form a computer-implemented process, such that said instructions executed on the computers or other programmable data processors can provide steps for implementing the functions or operations specified in the flow charts and/or one or more blocks of the block diagrams. It shall also be noted that in some alternative implementations, the functions/operations shown in the blocks may not occur in the order shown in the flow charts. For example, two block shown sequentially can actually be executed almost simultaneously or sometimes in reverse order, depending on the functions/operations involved.

The above examples mainly illustrate the detecting system and detecting method of the present disclosure. Although only some of the embodiments of the present disclosure have been described, those ordinarily skilled in the art shall understand that that the present invention can be implemented in many other forms without departing from its principle and scope. Therefore, the examples and implementations described are regarded as illustrative rather than restrictive, and the present invention may cover various modifications and substitutions as long as they do not depart from the spirit and scope of the present invention as defined by the appended claims.

What is claimed is:

1. A system for detecting elevator maintenance behaviors of a maintainer in an elevator hoistway, which comprises:

an emitting component for emitting wireless signals including channel state information (CSI) into the elevator hoistway;

a receiving component for receiving the CSI from the elevator hoistway; and a maintenance behavior detecting device coupled to the receiving component, which comprises:

a memory that stores CSI image recognition models constructed corresponding to one or more predefined elevator maintenance behaviors and a corresponding computer program executable on a processor; and the processor, which is configured to be able to execute the computer program to implement the following operations:

processing data of the received CSI to obtain a CSI image corresponding to the elevator maintenance behavior detected; and inputting the CSI image to the CSI image recognition model for analysis and processing so as to detect the elevator maintenance behavior of the maintainer in the elevator hoistway.

2. The system according to claim 1, wherein the operation of processing data of the received CSI to obtain CSI images corresponding to the elevator maintenance behaviors detected includes the following procedures:

denoising the received CSI;

removing background information from the CSI; and converting the CSI, removed the background information therefrom, corresponding to multiple subcarriers to generate a corresponding CSI image.

3. The system according to claim 1, wherein the emitting component and the receiving component are mounted on the outer top of the elevator cab in the elevator hoistway, and the emitting component and the receiving component travel synchronously with the elevator cab.

4. The system according to claim 1, wherein the emitting component is a WiFi wireless access point device, and the receiving component is a WiFi wireless network card.

5. The system according to claim 1, wherein the predefined elevator maintenance behavior includes a dangerous maintenance behavior; and the operation of inputting the CSI image to the CSI image recognition model for analysis and processing so as to detect the elevator maintenance behaviors includes: identifying whether the elevator maintenance behavior is the dangerous maintenance behavior.

6. The system according to claim 1, wherein the predefined elevator maintenance behaviors includes multiple types of maintenance behaviors;

the operation of inputting the CSI image to the CSI image recognition model for analysis and processing so as to detect the elevator maintenance behavior includes: classifying the elevator maintenance behavior into a certain type of maintenance behavior.

7. The system according to claim 5, which further comprises:

a reminder component which is used to send a reminder signal indicating that the elevator maintenance behavior currently being detected is the dangerous maintenance behavior.

8. The system according to claim 1, wherein the CSI image recognition model includes a behavior feature library corresponding to behavior feature models of the predefined elevator maintenance behaviors.

9. The system according to claim 8, wherein the processor is further configured to be able to execute the computer program to implement the following operations:

collecting the CSI corresponding to the predefined elevator maintenance behaviors and using it as training data; and training on the basis of the training data to obtain the behavior feature models.

10. The system according to claim 9, wherein the processor is further configured to be able to execute the computer program to implement the following operations:

inputting the recognized CSI image as training data into an original CSI image recognition model that has stored the behavior feature model; and updating the original CSI image recognition model using a machine learning algorithm to obtain the CSI image recognition model.

11. The system according to claim 1, wherein the processor is further configured to be able to execute the computer program to implement the following operations:

corresponding the time, amplitudes of multiple subcarriers in the time domain and frequencies of multiple subcarriers in the time domain of the CSI to R, G and B components of an image and realizing a matrix representation to generate the CSI image;

segmenting an image flow using a time window to obtain a series of CSI images;

inputting the series of CSI images into the CSI image recognition model for analysis and processing to identify the elevator maintenance behavior.

12. The system according to claim 1, wherein the CSI image recognition model is a convolution neural network model.

13. A method for detecting elevator maintenance behaviors of a maintainer in an elevator hoistway, which comprises:

(S1) receiving channel state information (CSI), wherein the CSI is included in wireless signals emitted into the elevator hoistway;

(S2) processing data of the received CSI to obtain a CSI image corresponding to the elevator maintenance behavior detected; and (S3) inputting the CSI image to a CSI image recognition model for analysis and processing so as to detect the elevator maintenance behavior of the maintainer in the elevator hoistway, wherein the CSI image recognition model is constructed corresponding to one or more predefined elevator maintenance behaviors of the maintainer in the elevator hoistway.

14. The method according to claim 13, wherein (S2) includes:

a data pre-processing operation which includes denoising the received CSI;

a background removing operation which removes background information from the CSI;

an image converting operation which converts the CSI, removed the background information therefrom, corresponding to multiple subcarriers to generate corresponding CSI images.

15. The method according to claim 13, wherein the predefined elevator maintenance behaviors include a dangerous maintenance behavior;

wherein (S3) includes identifying whether the elevator maintenance behavior is the dangerous maintenance behavior.

16. The method according to claim 13, wherein the predefined elevator maintenance behaviors include various types of maintenance behaviors;

wherein (S3) includes classifying the elevator maintenance behavior into a certain type of maintenance behavior.

17. The method according to claim 15, further comprising:

sending a reminder signal upon identifying the dangerous maintenance behavior.

18. The method according to claim 13, wherein the CSI image recognition model includes a behavior feature library corresponding to behavior feature models of the predefined elevator maintenance behaviors;

the method further comprises:

collecting the CSI corresponding to the predefined elevator maintenance behaviors and using it as training data; and training on the basis of the training data to obtain the behavior feature models.

19. The method according to claim 18, wherein the CSI image recognition model is constructed or updated through the following operations:

inputting the recognized CSI image as training data into an original CSI image recognition model that has stored the behavior feature model; and updating the original CSI image recognition model using a machine learning algorithm to obtain the CSI image recognition model.

20. The method according to claim 13, wherein (S2) includes:

corresponding the time, amplitudes of multiple subcarriers in the time domain and frequencies of multiple subcarriers in the time domain of the CSI to R, G and B components of an image and realizing a matrix representation to generate the CSI image;

segmenting an image flow using a time window to obtain a series of CSI images;

wherein (S3) includes:

inputting the series of CSI images into the CSI image recognition model for analysis and processing to identify the elevator maintenance behavior.

21. The method according to claim 13, wherein the CSI image recognition model is a convolution neural network model.

22. A computer device, which comprises a memory, a processor, a CSI image recognition model stored on the memory and constructed corresponding to one or more predefined elevator maintenance behaviors, and corresponding computer programs executable on the processor, wherein the processor can execute the programs to implement the method of claim 13.

23. A computer-readable storage medium, on which a CSI image recognition model constructed corresponding to one or more predefined elevator maintenance behaviors and corresponding computer programs executable on the processor are stored, wherein said programs can be executed by the processor to implement the method of claim 13.

* * * * *